US005671690A

United States Patent [19]

Trost

[11] Patent Number: 5,671,690

[45] Date of Patent: Sep. 30, 1997

[54] VARIABLE CAMBER INFLATABLE AIRFOIL

[76] Inventor: Michael D. Trost, Rte. 2, P.O. Box 2F 779 Main St., Wabasso, Minn. 56293

[21] Appl. No.: 569,880

[22] Filed: Dec. 8, 1995

[51] Int. Cl.[6] ..... B63H 9/04

[52] U.S. Cl. ..... 114/103

[58] Field of Search ..... 114/39.1, 102, 114/103, 104, 105, 106, 107, 108

[56] References Cited

U.S. PATENT DOCUMENTS 5,279,241 1/1994 Aguilera ..... 114/103

5,333,569 8/1994 Henderson ..... 114/103

*Primary Examiner*—Stephen Avila

*Attorney, Agent, or Firm*—Haugen and Nikolai, P.A.

[57] ABSTRACT

A variable camber inflatable airfoil for primary use with sailing vessels. The airfoil consists of a port and a starboard airfoil panel connected to a mast to partially or entirely enclose the mast. The airfoil is further provided with various air-inlet ports to inflate the airfoil in either a dynamic fashion, with the airfoil being inflated via the air pressure from the ingress of air into the air-inlet ports during sailing, or alternatively, the airfoil may be inflated in a static fashion, with the air pressure within the airfoil remaining constant by being inflated and sealed off. Upon inflation, the shape of the airfoil may be adjusted by applying and removing tension from tension points on the port and starboard panels of the airfoil to obtain the optimal airfoil shape for the particular angle of attack and desired lift-to-drag ratio.

29 Claims, 14 Drawing Sheets

VARIABLE CAMBER INFLATABLE AIRFOIL

BACKGROUND OF THE INVENTION

I. Field of the Invention

The present invention relates generally to an improved sail construction for wind powered vessels, such as sailboats, sailboards, or iceboats. More particularly, the present invention relates to an improved sail construction comprising an airfoil having a fully inflatable sail area and having a selectively adjustable camber depending on the particular angle of attack and desired lift-to-drag ratio.

II. Discussion of the Prior Art

In an effort to improve the aerodynamic efficiency of sailing vessels, sail makers have for years worked toward producing sails having enhanced performance characteristics. These efforts focus largely upon manipulating the air pressure differential that forms between the windward and leeward sides of the sail as wind flows therepast and, more particularly, the degree to which lift and drag forces are formed about and act upon the sail. Aerodynamically speaking, these lift and drag forces are based on a plurality of factors, including the angle between the chord of the sail and the apparent wind (referred to hereinafter as "angle of attack"), the speed of the true and apparent wind, and, of particular importance to the present invention, the shape of the sail.

Traditional sail construction consists of a single triangular sheet member having a concave windward sail surface and a convex leeward sail surface. A vessel employing such a sail is propelled in a windward direction due to the combination of a large negative or suction force that acts upon the leeward sail surface, as well as a smaller positive force that is exerted upon the windward sail surface. The negative pressure that develops on the leeward sail surface may be explained in terms of the Bernoulli principle, which states that an increased airflow velocity in relation to the velocity of the surrounding free air stream causes a decrease in pressure within the faster flowing air. The airflow about the leeward sail surface experiences an increase in velocity due to the fact that the airflow adheres to the convex surface of the leeward sail surface as it flows therepast.

In order to follow the curved sail surface, the airflow is bent outward toward the laminar free air stream that flows generally parallel to the chord of the sail. The free air stream, having a small amount of inertia, acts as a wall or barrier to the airflow as it curves outward along the convex leeward sail surface. This effective barrier, in combination with the physical surface of the leeward sail surface, creates a narrow channel through which the initial volume of air has to travel. Because air is essentially incompressible at sea level, it must speed up to get the same volume of air through the narrow channel. This increase in airflow velocity, and the resultant decrease in pressure, set up an aerodynamic chain reaction whereby the new air which approaches the leading edge of the sail is attracted to the low pressure along the leeward sail surface. This, in turn, requires a larger volume of airflow to pass through the narrow channel between the convex leeward sail surface and the free air stream which, consequently, increases the velocity of the airflow and decreases the pressure within the airflow. The increase in airflow volume over the leeward sail surface also causes the airflow volume over the windward sail surface to decrease which allows the velocity of the airflow in the windward sail surface to decrease and, consequently, causes an increase in the overall pressure exerted upon the windward sail surface. The end result is a strong negative pressure on the leeward sail surface and a moderate positive pressure on the windward sail surface, both acting on the sail in the same direction.

At optimal angles of attack, a traditional single sheet sail of such a construction performs modestly, with a lift-to-drag ratio that facilitates a relatively efficient transfer of wind energy into vessel speed. However, as the vessel varies from this optimal angle of attack, the aerodynamic efficiency of the sail decreases significantly due to the single sheet nature of the sail. In particular, the drag resulting from the windward sail surface increases to a considerable degree at low angles of attack, thereby causing the traditional sail to experience luffing proximate the leading edge during a close hauled tacking condition.

Airfoil-type sails have been introduced to overcome these deficiencies, boasting a dual-ply construction to provide windward and leeward cambers of varying degree and size for greater aerodynamic efficiency. Such airfoils typically employ an internal framework of ribs or strut members to maintain the leeward and windward sail members in proper aerodynamic form. However, such internal support structures restrict the degree to which the airfoil can respond to variations in wind conditions and angles of attack, thereby limiting the responsiveness and aerodynamic efficiency of the airfoil. These internal support structures also add to the overall weight of the airfoil. When sailing with a high degree of heel, such as is common when sailing in heavy wind conditions, this added weight in the airfoil can increase the likelihood of tipping the vessel over such that the sail and mast contact and possibly submerge in the water. Similarly, the extra weight of the support structures may increase the difficulty in righting the vessel from the potentially perilous conditions of being tipped over or capsized. Such internal support structures pose another potential problem in that, when dealing with ram-air or dynamically inflated airfoils having an open air-injection port, the internal support structures may act to trap water within the airfoil during instances of being capsized or tipped over, thereby increasing the difficulty in righting the vessel under such conditions.

A difficulty also exists in the prior art with regard to tuning the shape of the airfoils. More particularly, the prior art airfoils are limited in their ability to have the leeward and windward cambers adjusted in response to variations in wind conditions and angles of attack. Prior art airfoils may be either fixed in shape, with a generally constant ratio of windward camber to leeward camber, or dynamically shaped, wherein the airfoil distorts in response to wind pressure as the magnitude of the angle of attack increases such that the shape of the airfoil becomes increasingly asymmetric in response to an increased angle of attack.

Various flaps and lift devices have been introduced to modify the shape of rigid airfoils. However, such devices are only capable of adjusting the shape of the airfoil in general to roughly approximate the optimal airfoil shape. Moreover, such devices add to the complexity and cost of producing the airfoils, and typically result in a larger amount of drag than is found in an airfoil designed for that particular angle of attack and wind condition. As to the dynamically shaped airfoils, other than the automatic change in shape in response to the impinging wind, the degree to which the shape of the airfoil can be adjusted is limited to the use of standard sail trimming mechanisms, such as an outhaul, a downhaul (cunningham), and/or a boom vang. As such, they do not provide the fine adjustments necessary to tailor the shape of each side of the airfoil to obtain the optimal lift-to-drag ratio for a particular angle of attack or wind condition.

OBJECTS AND SUMMARY OF THE INVENTION

Accordingly, it is a primary object of the present invention to provide an airfoil sail for use with sailing vessels that is capable of being fine tuned in response to variations in angle of attack and wind conditions to maximize the aerodynamic efficiency of the airfoil.

It is another object of the present invention to provide an airfoil that is free from internal support ribs so as to minimize the likelihood that water will become trapped within the airfoil during a condition wherein the vessel is tipped over or capsized.

It is still another object of the present invention to provide an airfoil that is simple in construction and light in weight so as to minimize the potential that the sailing vessel will tip over during heavy winds.

In accordance with a broad aspect of the present invention, an inflatable airfoil assembly is provided for use with a sailing vessel, comprising mast means having an upper end and a lower end, the lower end being coupled to the sailing vessel and the upper end extending generally vertically away therefrom, and boom means having a first end coupled to the mast means and a second end extending distally therefrom. Inflatable airfoil means are further provided having an internally disposed inflation cavity bounded by leading edge means positioned adjacent to the mast means, foot edge means extending from the second end of the boom means toward the mast means, and trailing edge means extending between the second end of the boom means and the upper end of the mast means. Leading edge means includes a first leading edge and a second leading edge disposed in spaced relation proximate the mast means, the airfoil means further including first tension point means disposed a predetermined distance away from the first leading edge, second tension point means disposed a predetermined distance away from the second leading edge, and air injection means for introducing a volume of air into the inflation cavity to force the airfoil means into an airfoil shape. Adjustment means are further provided attached to the first and second tension point means for selectively forming the trailing edge means at one of the first and second tension point means to thereby selectively adjust the camber of the airfoil means.

In another broad aspect of the present invention, an inflatable airfoil is provided for use with a sailing vessel having a mast member and a boom member, the airfoil comprising first panel means extending between leading edge means, foot edge means, and trailing edge means, wherein the first panel means has first tension point means disposed thereon. Second panel means are provided between the leading edge means, the foot edge means, and the trailing edge means, wherein the second panel means has second tension point means disposed thereon. Air injection means are further provided for introducing a volume of air between the first and second panel means to form an internally disposed inflation cavity therebetween. Adjustment means are further provided attached to the first and second tension point means for forming the trailing edge means at the approximate location of one of the first and second tension point means to thereby selectively adjust the camber of the airfoil.

In yet another broad aspect of the present invention, a method is disclosed for improving the aerodynamic efficiency of a sailing vessel, the sailing vessel having a mast member and a boom member, comprising the steps of: (i) providing airfoil means having an internally disposed inflation cavity, the inflation cavity being bounded by leading edge means, foot edge means, and trailing edge means, the airfoil means having first tension point means disposed a predetermined distance from the leading edge means, second tension point means disposed a predetermined distance from the leading edge means, and air injection means for introducing a volume of air into the inflation cavity; (ii) introducing a volume of air into the inflation cavity to produce an internal air pressure capable of forcing the inflation cavity into spaced relation to assume a generally airfoil shape; (iii) providing adjustment means in attachment with the first and second tension point means for selectively forming the trailing edge means at the approximate location of one of the first and second tension point means; and (iv) adjusting the adjustment means to vary the camber of the airfoil means.

DETAILED DESCRIPTION OF THE PREFERRED EMBODIMENTS

Figure 1:
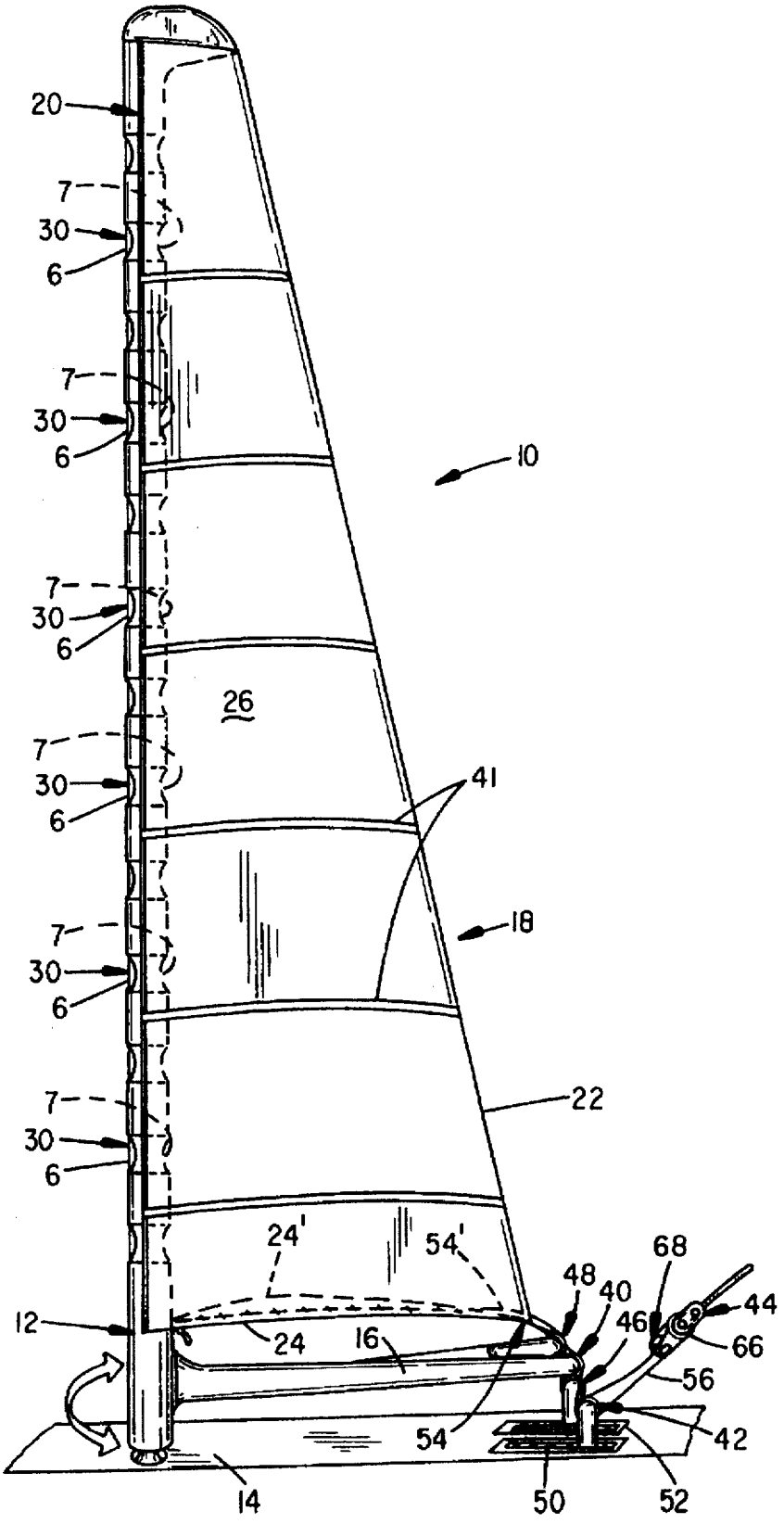
FIG. 1 is a side elevational view of a first preferred embodiment of the present invention, illustrating an airfoil assembly 10 with a dynamically inflatable airfoil 18 for use with a sailing vessel 14.
Figure 2:
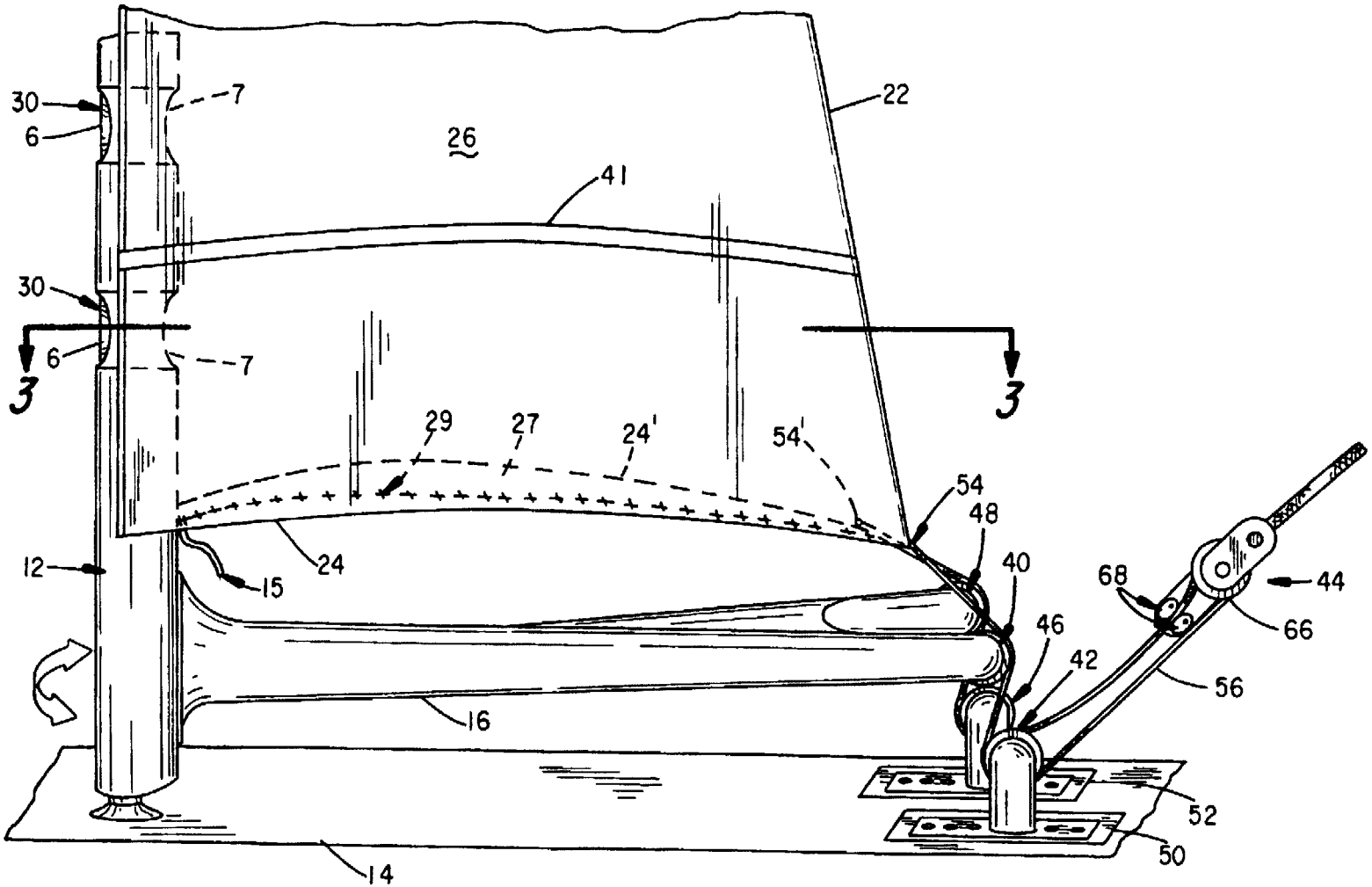
FIG. 2 is an enlarged view of that which is shown in FIG. 1, detailing the construction of the lower portion of the airfoil 18 and the boom member 16.

Referring initially to FIGS. 1 and 2, shown is an airfoil assembly of the present invention, indicated generally by reference numeral 10. In this particular embodiment, airfoil assembly 10 includes an airfoil 18 capable of being dynamically inflated during use with a sailing vessel, a rotatable mast member 12 extending in a generally vertical fashion from a deck surface 14, and a rigid boom member 16 hingedly attached to mast member 12 and extending in a generally perpendicular fashion therefrom. A plurality of air inlet ports 30 are formed within mast member 12, each air inlet port 30 having an forwardly disposed leading aperture 6 in fluid communication with an rearwardly disposed trailing aperture 7. Airfoil 18 is provided with a port leading edge 20 and a starboard leading edge (not shown), each being slidably attached to mast member 12 via a complimentary bolt rope and track configuration that is well known in the art. More specifically, airfoil 18 is attached to mast member 12 such that port leading edge 20 and starboard leading edge (not shown) are positioned in spaced relation along opposing lateral edges of mast member 12 so as to envelop each trailing aperture 7 of the plurality of air inlet ports 30. This positioning ensures that airfoil 18 will experience adequate inflation during use which, in turn, helps create the proper airfoil shape and allows a user to point more directly into the wind or sail at lower angles of attack without experiencing luffing near mast member 12. A plurality of horizontally extending battens 41 are further provided for the added structural support for airfoil 18.

Referring to FIG. 2, a distendable foot edge swath 27 extends laterally between a port foot edge 24 and a starboard foot edge 24' and longitudinally between a trailing edge 22 formed at the aft portion of airfoil 18 and mast member 12. Foot edge swath 27 is optimally constructed of a highly stretchable material, such as spandex, to conform to the adjustable airfoil camber of the present invention. As such, foot edge swath 27 is capable of stretchably distending between port and starboard foot edges 24, 24' under any and all angles-of-attack, tacking directions (port or starboard), and airfoil camber setting so as not to impede the shaping or adjustability of airfoil 18. Optionally, foot edge swath 27 may be equipped with a selectively openable air exhaust port 29 so as to adjust the degree to which airfoil 18 is inflated during use. Air exhaust port 29 is shown as a common interlocking zipper mechanism with a handle member 15 extending therefrom as a purchase point for progressively opening air exhaust port 29 to allow air to flow therethrough. It should be evident that air exhaust port 29 may include a variety of manually openable mechanisms, such as Velcro, snap fittings, or the like.

Shown during a port tack, wherein an impinging wind flows over the port side of the vessel toward the starboard side of the vessel, trailing edge 22 is formed along an aft portion of airfoil 18 and extends angularly upward from a first tension point 54 toward the upper end of mast member 12. The formation of trailing edge 22 during this tack is accomplished by applying tension to first tension point 54 while simultaneously removing tension from a second tension point 54'. With collective reference to FIGS. 1–2, and 4A–4B, an internally disposed inflation cavity 8 is formed between a port airfoil panel 26 and a starboard airfoil panel 28, wherein port airfoil panel 26 is defined between port leading edge 20, port foot edge 24, and trailing edge 22, and wherein starboard airfoil panel 28 is defined between starboard leading edge 20', starboard foot edge 24', and trailing edge 22. In the preferred embodiment shown, the application and removal of tension to first and second tension points 54, 54' is performed via a tension line 56 having a first end removably attached to first tension point 54 and a second end removably attached to second tension point 54'. Tension line 56 extends from first tension point 54 and travels through a port boom roller 40, a port traveler roller 42, and a block and tackle assembly 44 before passing through a starboard traveler roller 46 and a starboard boom pulley 48 to terminate in attachment at second tension point 54'. Block and tackle assembly 44 includes a roller 66 and a jam cleat 68 which collectively provide the ability to selectively apply tension to either first tension point 54 or second tension point 54'. In doing so, the shape of airfoil 18 may be selectively tailored depending upon the particular angle of attack or desired lift-to-drag ratio. More particularly, the camber or curvature depth of port airfoil panel 26 and starboard airfoil panel 28 may be selectively adjusted to provide optimal aerodynamic efficiency for airfoil 18. As noted earlier, foot edge swath 27 is distendable so as to allow the unimpeded and unhindered shaping of port and starboard airfoil panels 26, 28 to produce airfoil 18 with an improved camber for greater aerodynamic efficiency.

Figure 3:
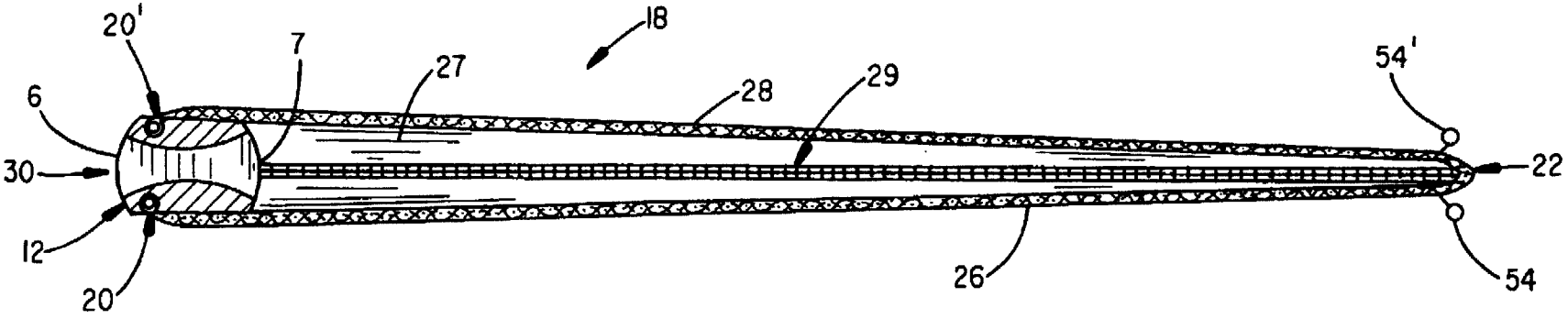
FIG. 3 is a partial sectional view similar to that taken along lines 3—3 of FIG. 2, illustrating the dynamically inflatable airfoil 18 of the present invention in an uninflated and untensioned condition.

Turning to FIG. 3, shown is a partial sectional view of the present invention similar to that taken along lines 3—3 in FIG. 2, depicting airfoil 18 in an uninflated and untensioned condition. With first and second tension points 54, 54' in a loose and untensioned state, trailing edge 22 is formed at the approximate midline between port leading edge 20 and starboard leading edge 20', thereby defining port and starboard airfoil panels 26, 28 to have equal cross sectional shape and size. It is important to note that first tension point 54 and second tension point 54' are positioned a predetermined and equal distance from port leading edge 20 and starboard leading edge 20'. Arranged as such, trailing edge 22 may be selectively shifted from the approximate midline between port and starboard leading edges 20, 20' to vary the cross sectional length of port or starboard airfoil panels 26, 28 depending upon the particular tack, angle of attack, or desired lift-to-drag ratio. In other words, the length of the sail material extending along one side of airfoil 18 is reduced while the length of the sail material extending along the opposite side of airfoil 18 is lengthened by the same amount. Depending upon the angle of attack, and the degree to which tension is applied to first or second tension points 54, 54', this variation in the cross sectional length of port and starboard airfoil panels 26, 28 allows the camber or curvature depth of each airfoil panel 26, 28 to be modified to improve the camber, and hence aerodynamic efficiency, of airfoil 18.

Referring to FIGS. 4A–4D, the camber of first and second airfoil panels 26, 28 is shown at varying angles of attack. Each angle of attack $\phi 1$–$\phi 4$ in FIGS. 4A–4D is defined as the angle between reference line 80 and reference line 90. More particularly, each reference line 80 represents the chord of airfoil 18, i.e. the straight line between port and starboard leading edges 20, 20' and trailing edge 22, while each reference line 90 represents the direction of the relative or apparent wind. A third tension point 74 and a complimentary fourth tension point 74' are further provided to illustrate the degree to which trailing edge 22 may be adjusted to vary the cross sectional length, and hence the camber, of port and starboard airfoil panels 26, 28. Again, it is important to note that each complimentary pair of tension points (54, 54' and 74, 74') is positioned a predetermined and equal distance from port leading edge 20 and starboard leading edge 20. The equi-distant configuration of each pair of tension points is also apparent with reference to a midline 76 which longitudinally bisects airfoil 18. Viewed from this vantage point, first and second tension points 54, 54' are disposed symmetrically about midline 76, as are third and fourth tension points 74, 74'. For clarification, first, second, third, and fourth tension points 54, 54', 74, 74' are shown as attachment rings extending a predetermined distance away from airfoil 18. However, it is to be understood that any number of attachment means may be provided in substitute for the rings shown without departing from the scope of the invention.

Figure 4A:
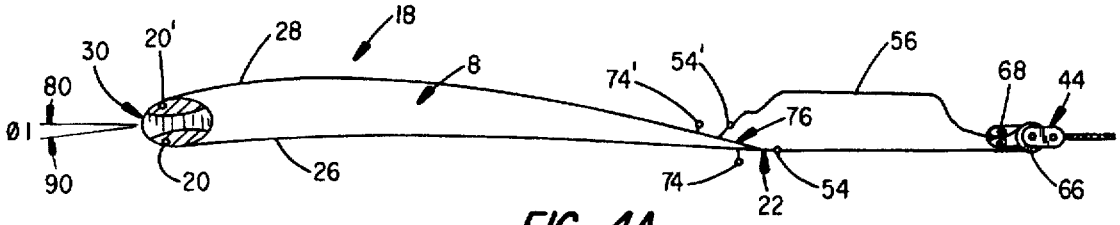
FIG. 4A is a partial sectional view similar to that taken along lines 3—3 of FIG. 2, illustrating the dynamically inflatable airfoil 18 of the present invention in an inflated condition, at a high angle of attack, with tension applied to first tension point 54.
Figure 4B:
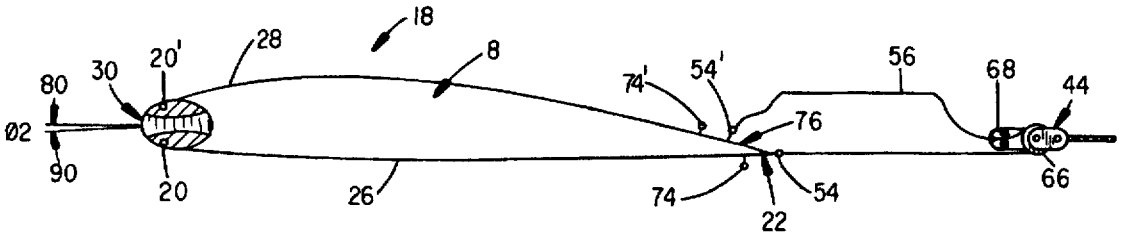
FIG. 4B is a partial sectional view similar to that taken along lines 3—3 of FIG. 2, illustrating the dynamically inflatable airfoil 18 of the present invention in an inflated condition, at a low angle of attack, with tension applied to first tension point 54.

With specific reference to FIGS. 4A and 4B, airfoil 18 is shown on a port tack with tension line 56 in attachment with first and second tension points 54, 54'. To facilitate the proper shaping of airfoil 18, tension line 56 is manipulated through to jam cleat 68 to apply tension to first tension point 54 and to release second tension point 54' so as to form trailing edge 22 proximate to first tension point 54. With trailing edge 22 disposed as such, the cross sectional length of port airfoil panel 26 is decreased, while the cross sectional length of starboard airfoil panel 28 is increased. This added sail area along starboard airfoil panel 28 provides starboard airfoil panel 28 with an increased camber or curvature depth relative to that of port airfoil panel 26. This differential in camber causes the airflow velocity over starboard airfoil panel 28 to increase, thereby producing an increased suction force acting upon starboard airfoil panel. Moreover, the reduction in the sail area along port airfoil panel 26 effectively reduces the degree to which drag forms along port airfoil panel 26 during windward use.

Figure 4C:
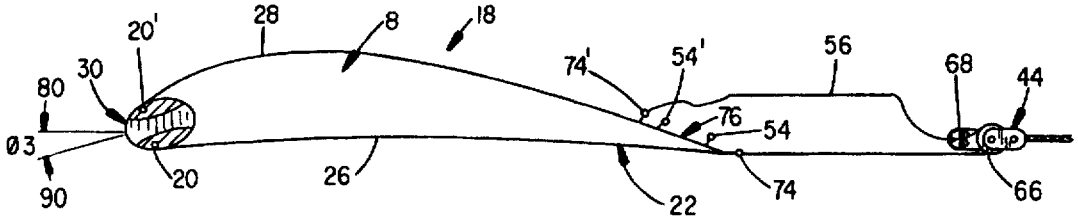
FIG. 4C is a partial sectional view similar to that taken along lines 3—3 of FIG. 2, illustrates the dynamically inflatable airfoil 18 of the present invention in an inflated condition, at a high angle of attack, with tension applied to third tension point 74.
Figure 4D:
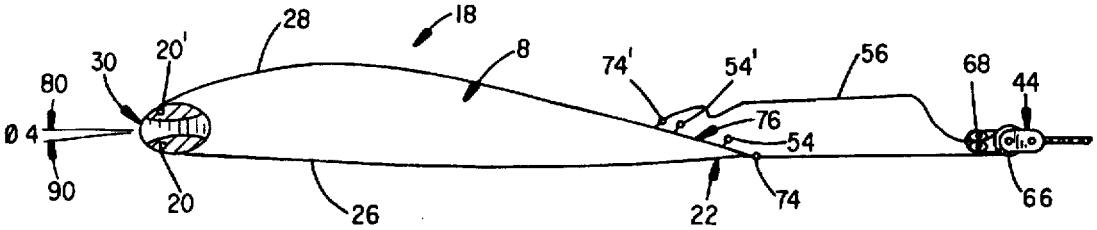
FIG. 4D is a partial sectional view similar to that taken along lines 3—3 of FIG. 2, illustrates the dynamically inflatable airfoil of 18 the present invention in an inflated condition, at a low angle of attack, with tension applied to third tension point 74.

Referring specifically to FIGS. 4C and 4D, airfoil 18 is shown on a port tack with tension line 56 in attachment with third and fourth tension points 74, 74'. In similar fashion, tension line 56 is employed to form trailing edge 22 proximate third tension point 74. In this instance, with third and fourth tension points 74, 74' disposed farther away from midline 76 than first and second tension points 54, 54', the cross sectional length along starboard airfoil panel 28 far exceeds that of port airfoil panel 26. As explained above, such a camber differential serves to increase the suction force forming about and acting upon starboard airfoil panel 28, while decreasing the degree to which drag forces form along port airfoil panel 26. This increases the ability of airfoil 18 to obtain higher lift with reduced drag, thereby resulting in greater boat speed.

In FIGS. 4A–4D, the camber of port airfoil panel 26, and any drag forces associated therewith, may be adjusted so as to be minimized or maximized in one of several ways. One method includes adjusting the amount of tension applied to first tension point 54 to control the degree to which port airfoil panel 26 can resist the external pressure caused by the impinging airflow over port airfoil panel 26 and the internal pressure developing within inflation cavity 8. Another such method involves increasing the angle of attack so as to reduce the degree to which the impinging air distends the outer surface of port airfoil panel 26. Yet another method includes controlling the degree to which mast member 12 can experience rotation during use. With reference to FIG. 2, the rotation of mast member 12 can be maximized to increase the camber of port airfoil panel 26 by moving port and starboard travelers 50, 52 inwardly from the outer end of boom member 16 toward mast member 12. Conversely, the rotation of mast member 12 can be minimized to decrease the camber of port airfoil panel 26 by moving port and starboard travelers 50, 52 outwardly away from the outer end of boom member 16.

The camber of starboard airfoil panel 28 is largely dependent upon the positioning of trailing edge 22. More specifically, the cross sectional length of starboard airfoil panel 28 is left in a relaxed and untensioned condition which, due to the airflow into inflation cavity 8, extends to assume a full and uninhibited camber. This camber may be maximized by decreasing the amount of tension being applied to first and third tension points 54, 74. Conversely, the camber of starboard airfoil panel 28 may be minimized by increasing the tension applied to first and third tension points 54, 74. Therefore, depending upon the desired lift-to-drag ratio, the aforementioned camber adjustment techniques may be employed to adjust the degree to which lift forces and drag forces act upon airfoil 18. For example, the cambers of port and starboard airfoil panels 26, 28 in FIG. 4A result in a low lift and high speed for airfoil 18, while the cambers of port and starboard airfoil panels 26, 28 in FIG. 4B result in a lower lift and a higher speed for airfoil 18. In a similar fashion, the cambers of port and starboard airfoil panels 26, 28 in FIG. 4D result in a high lift and low speed for airfoil 18, while the cambers of port and starboard airfoil panels 26, 28 in FIG. 4C produce a higher lift and lower speed for airfoil 18.

Figure 5:
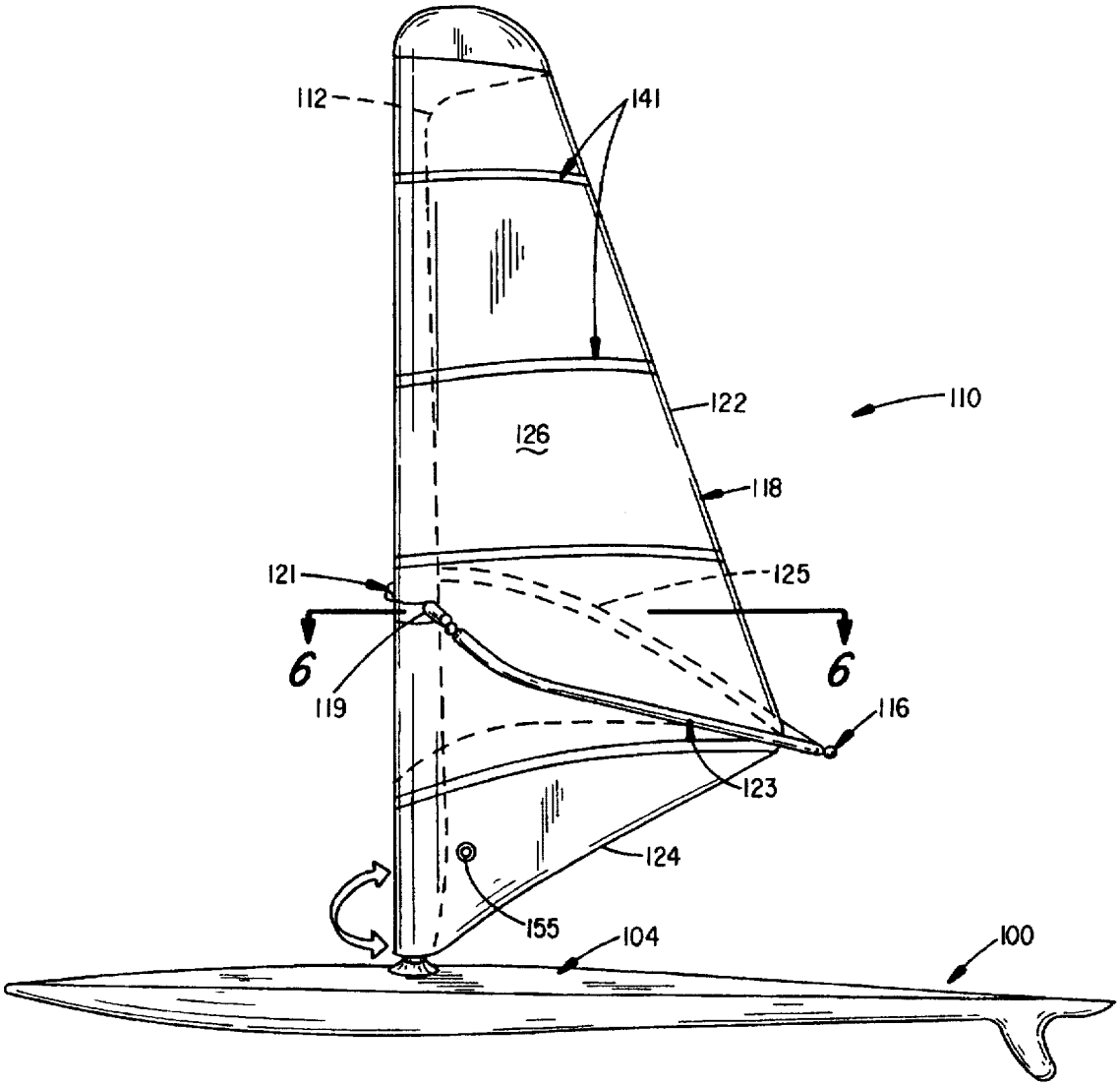
FIG. 5 is a side elevational view of a second preferred embodiment of the present invention, illustrating an statically inflatable airfoil 118 for use with a sailboard 100.

Referring now to FIG. 5, shown is a second preferred embodiment of the present invention, illustrating an airfoil assembly, indicated generally by reference numeral 110. Airfoil assembly 110 includes a statically inflatable airfoil 118 supported between a rotatable mast member 112 and a multi-segment boom assembly, indicated generally by reference numeral 116. Mast member 112 has a lower end coupled to the surface 104 of a sailboard 100 and an upper end extending generally vertically therefrom. Mast member 112 is further provided with a port attachment arm 119 and a starboard attachment arm 121, each extending from opposing lateral edges of mast member 112. Boom assembly 116 includes a port boom arm 123 and a starboard boom arm 125, each having a first end hingedly attached to port attachment arm 119 and starboard attachment arm 121, respectively, and a second end extending in a curved fashion therefrom along opposing surfaces of airfoil 118, respectively. A selectively openable air injection port 155 is provided along airfoil 118 capable of providing fluid communication between the atmosphere and an internally disposed and otherwise sealed inflation cavity 108. Air injection port 155 may include any number of common and available air injection means, such as a threaded spout or nozzle extending through airfoil 118 with a complementary threaded cap.

Figure 7A:
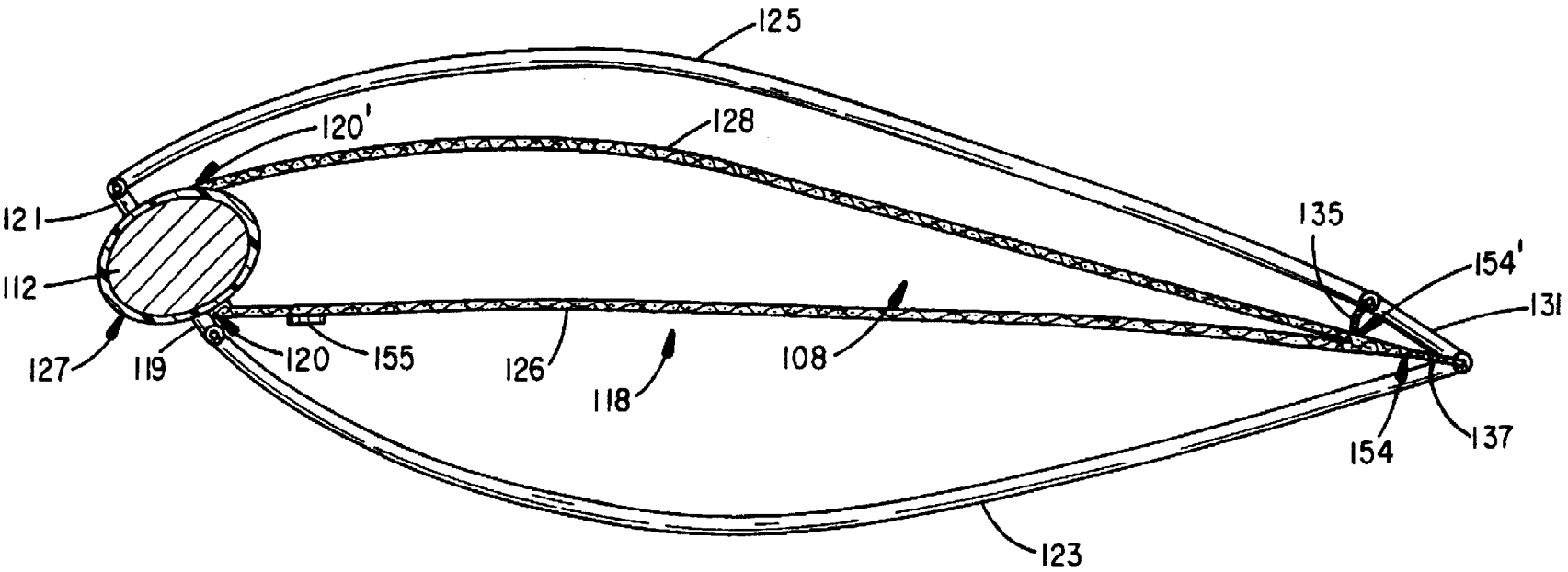
FIG. 7A is a partial sectional view similar to that taken along lines 6—6 of FIG. 5, illustrating the statically inflatable airfoil 118 of the present invention in an inflated condition and under a port tack wherein each boom arm 123, 125 of the boom assembly 116 is shifted with respect to the connecting arm 131 to adjust the camber of the port and starboard surfaces 126, 128 of the airfoil 118.

With collective reference to FIGS. 5 and 7A, airfoil 118 includes a vertically extending mast sleeve 127 capable of receiving mast member 112 therein, with a port and a starboard airfoil panel 126, 128 integrally attached thereto and extending rearward therefrom toward a connecting arm 131 of boom assembly 116. Connecting arm 131 is hingedly disposed between each second end of port and starboard boom arms 123, 125 and connected to a first tension point 154 and a second tension point 154' of airfoil 118 via a first tension line 137 and a second tension line 135, respectively. Internally disposed inflation chamber 108 is formed within airfoil 118 and is bounded laterally by port and starboard airfoil panels 126, 128, by a rearwardly facing portion of mast sleeve 127 between port and starboard leading edges 120, 120', by a trailing edge 122 that extends from first tension point 154 toward the upper end of mast member 112, and by a foot edge 124 that extends from first tension point 154 toward the lower end of mast member 112. It should be noted, however, that this specific positioning of trailing edge 122 and foot edge 124 relative to port and starboard leading edges 120, 120' is dependent upon the particular tack under which airfoil assembly 110 is operating, the particular length of connecting arm 131, as well as the location of first and second tension points 154, 154' along the opposing surfaces of airfoil 118.

To further explain, airfoil assembly 110 is shown during a port tack in FIGS. 5 and 7A, wherein an impinging wind flows from port to starboard across sailboard 100. Under such a port tack, the force applied to port boom arm 123 by a user causes mast member 112 to rotate counter clockwise which, in turn, causes starboard boom arm 125 and connecting arm 131 into a generally aligned relation. This shifting allows second tension point 154' to relax and distend toward starboard leading edge 120', which, in combination with the rearward motion of port boom arm 123, applies a tension to first tension point 154. As noted above, trailing edge 122 and foot edge 124 are thereby defined by this positioning of first tension point 154 relative to port and starboard leading edges 120, 120'. Thus, it follows that varying the length of connecting arm 131 and/or the points of attachment of first and second tension lines 137, 135 along airfoil 118, i.e. first and second tension points 154, 154', will vary point at which trailing edge 122 and foot edge 124 are formed in relation to port and starboard leading edges 120, 120'. Each variation in the positioning of trailing edge 122 and foot edge 124, in turn, redefines the cross sectional length of port and starboard airfoil panels 126, 128 or, in other words, redefines the camber of airfoil 118. In terms of the port tack shown in FIG. 7A, the cross sectional length of airfoil panel 126 is reduced while the cross sectional length of starboard airfoil panel 128 is increased. This increases the camber of starboard airfoil panel 128, which is thereby capable of generating an increased suction force to increase the lift of airfoil 118. Similarly, the aforementioned counter clockwise shifting minimizes the camber of port airfoil panel 126, thereby decreasing the extent to which drag forces are formed thereabout.

Figure 6:
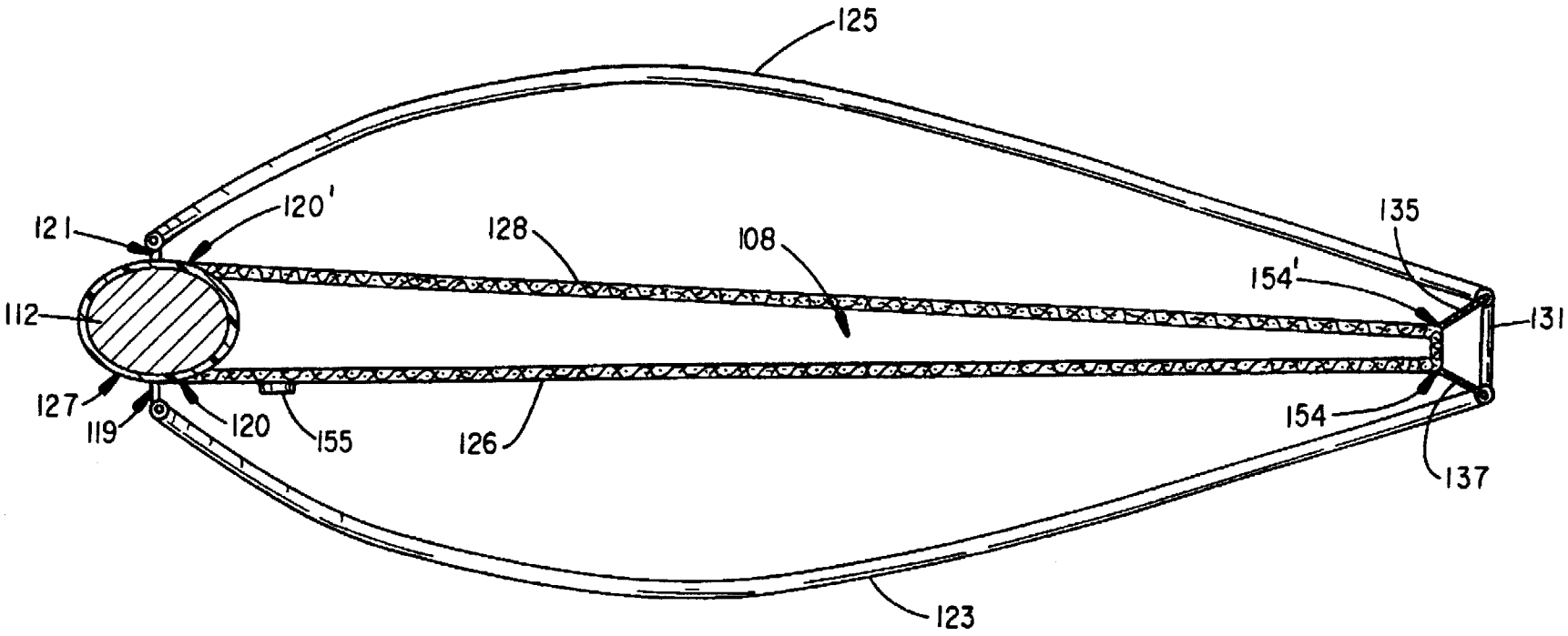
FIG. 6 is a partial sectional view similar to that taken along lines 6—6 of FIG. 5, illustrating the statically inflatable airfoil 118 of the present invention in an uninflated condition, with each boom arm 123, 125 of the boom assembly 116 positioned symmetrically between the mast member 112 and the connecting arm 131.

Referring now to FIG. 6, airfoil 118 is illustrated in an uninflated and untensioned condition to further detail the construction of airfoil 118 and boom assembly 116. In the untensioned condition shown, port and starboard boom arms 123, 125 extend rearward in a symmetrical fashion from port and starboard attachment arms 119, 121 to the hinged connection with connecting arm 131. Arranged as such, connecting arm 131 is positioned generally parallel to the plane which intersects port and starboard attachment arms 119, 121. This, in turn, causes first and second tension points 154, 154' to be tensioned in an equal amount, such that the swath of sail material extending between first and second tension points 154, 154' is generally parallel to connecting arm 131. This swath extends upward from first and second tension points 154, 154' toward the upper end of mast member 112 to form trailing edge 122 and downward from first and second tension points 154, 154' toward the lower end of mast member 112 to form foot edge 124. For clarification, then, the cross sectional length of port and starboard airfoil panels 126, 128 is approximately equal. As noted above, however, these cross sectional lengths may be adjusted by selectively applying tension to port and starboard tension points 154, 154', via the selective shifting of port and starboard boom arms 123, 125 relative to connecting arm 131, which, in turn, dictates the camber of port and starboard airfoil panels 126, 128.

Figure 7B:
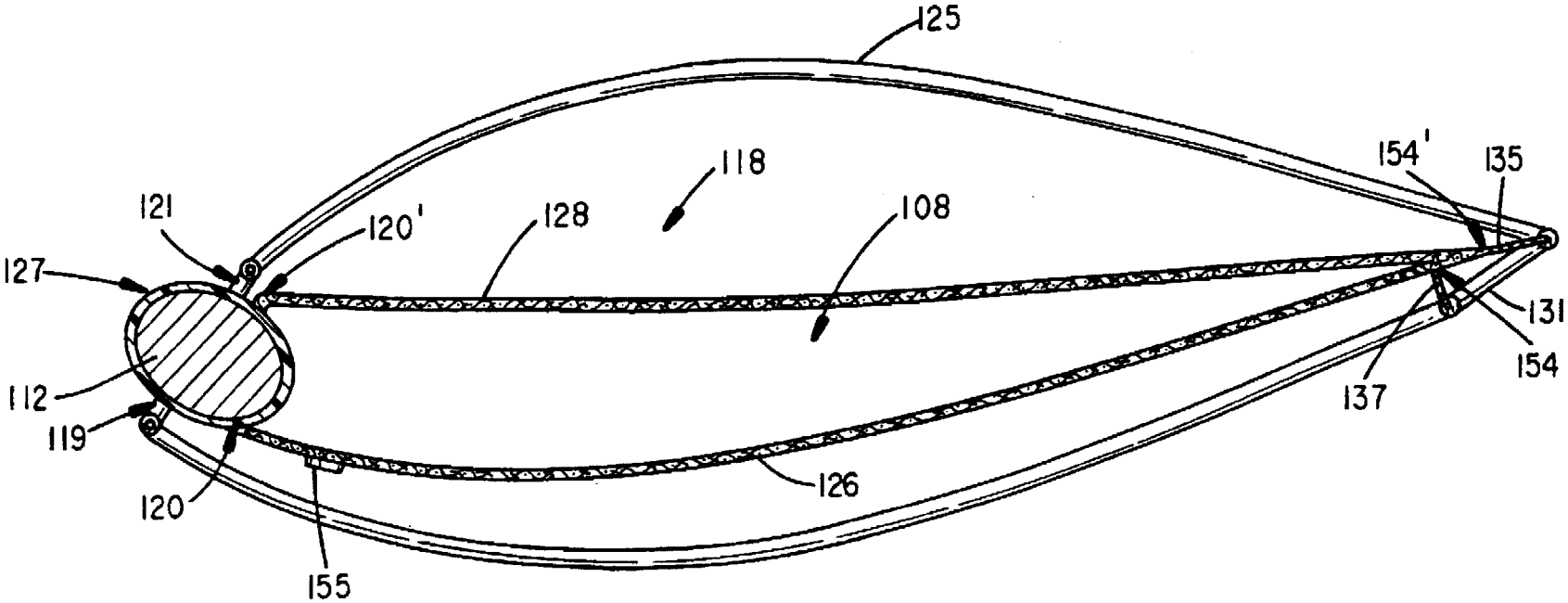
FIG. 7B is a partial sectional view similar to that taken along lines 6—6 of FIG. 5, illustrating the statically inflatable airfoil 118 of the present invention in an inflated condition and under a starboard tack wherein each boom arm 123, 125 of the boom assembly 116 is shifted with respect to the connecting arm 131 to adjust the camber of the port and starboard surfaces 126, 128 of the airfoil 118.

FIGS. 7A and 7B illustrate the manner in which these adjustments are accomplished in accordance with the present invention. In the normal operation of sailboards, a user is required to grasp the windward boom member in order to manipulate the position of the sail in relation to the wind to control the direction of travel. The multi-segment arrangement of boom assembly 116 furthers the functionality of the prior art sailboard booms by providing the ability to automatically adjust the cross sectional length of port and starboard airfoil panels 126, 128 depending upon the particular tack and angle of attack. FIG. 7B illustrates airfoil 118 of the present invention under a starboard tack. In this configuration, starboard boom arm 125 is deformed outwardly by a user such that mast member 112 is rotated in a clockwise direction to force port boom arm 123 into alignment with connecting arm 131. This clockwise shifting of port and starboard boom arms 123, 125 relative to connecting arm 131 forms trailing edge 122 between starboard tension point 154' and the upper end of mast member 112, while foot edge 124 is likewise formed between starboard tension point 154' and the lower end of mast member 112. As explained above, this effectively shortens the cross sectional length of starboard airfoil panel 128 and increases the cross sectional length of port airfoil panel 126 which, in turn, provides a decreased drag along starboard airfoil panel 128 and an increased suction force developing about and acting upon port airfoil panel 126.

Figure 8:
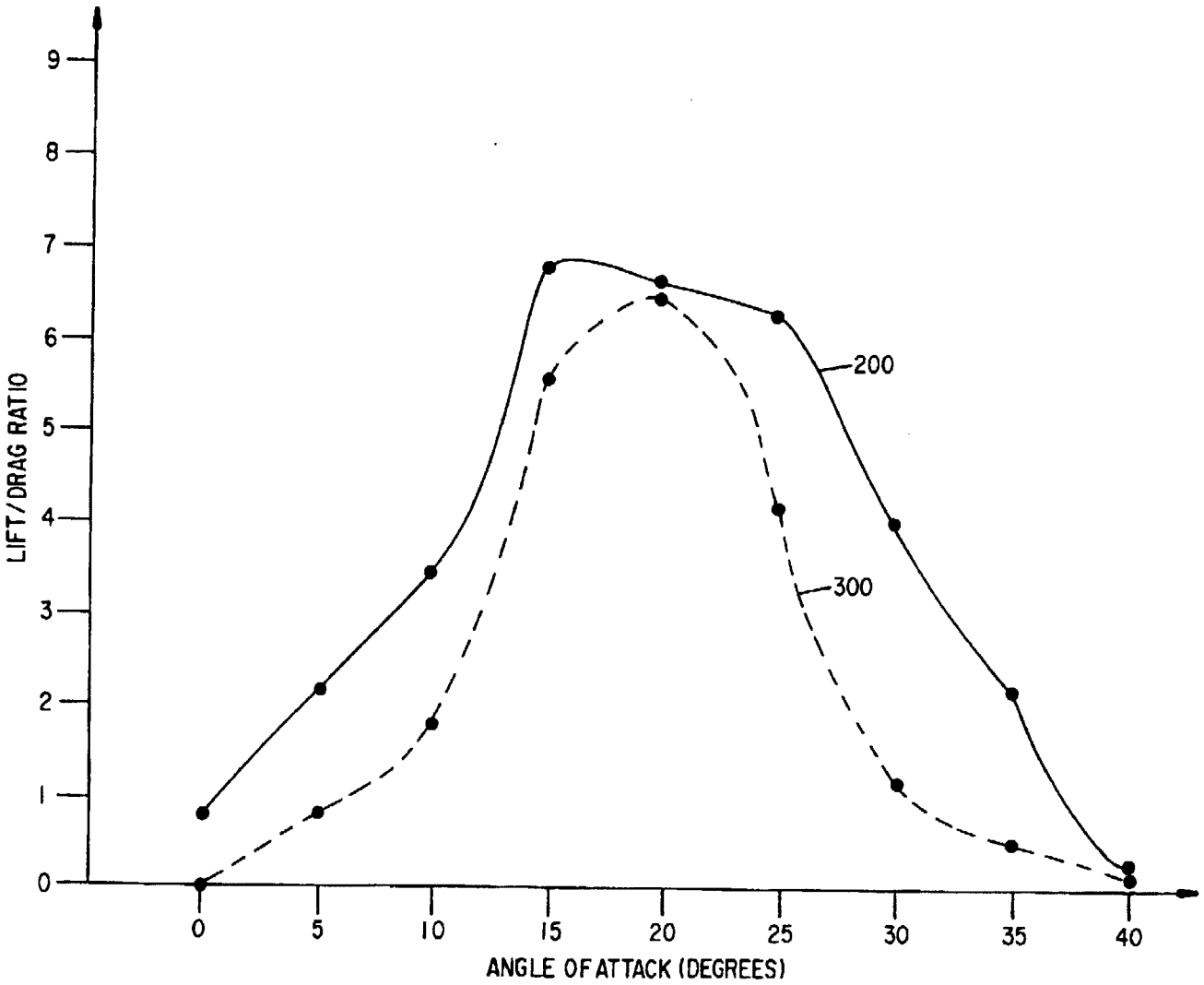
FIG. 8 is a chart illustrating the lift-to-drag ratio performance characteristics of a sailing vessel employing an inflatable airfoil of the present invention 200 and a sailing vessel employing a traditional sail 300 under varying angles of attack.

Turning now to FIG. 8, shown is a comparison between the lift-to-drag ratio of a traditional sail in relation to an improved airfoil of the present invention throughout a full range of angles of attack, represented graphically as lines 300 and 200, respectively. Byway of clarification, the ratio of lift to drag indicates the amount of lift that is generated by a sail at a particular angle of attack in relation to the amount of drag which is generated by the sail at the same angle of attack. A sail or airfoil having a high lift-to-drag ratio is able to propel a given vessel at greater speeds under a particular angle of attack than a sail or airfoil having a lower lift-to-drag ratio operating at that same angle of attack. As such, this ratio is an indirect indication of the speed attainable by the sailing vessel which employs such a sail or airfoil. This being the case, the vertical differential between lines 200 and 300 indicates that an airfoil of the present invention is capable of obtaining substantially greater lift-to-drag ratios during the lower angles of attack (approximately 0–18 degrees) and high angles of attack (approximately 22–35 degrees) than that attainable by a traditional sail. The airfoil of the present invention, therefore, provides a substantial improvement over the traditional sails of the prior art in that the present invention is capable of producing higher lift-to-drag ratios for virtually every angle of attack between 0 and 40 degrees, thereby resulting in greater boat speed during all sailing conditions within this range.

This invention has been described herein in considerable detail to provide those skilled in the art with the information needed to apply the novel principles and to construct and use embodiments of the example as required. However, it is to be understood that the invention can be carried out by specifically different devices and that various modifications can be accomplished without departing from the scope and spirit of the above-describe invention.

Figure 9A:
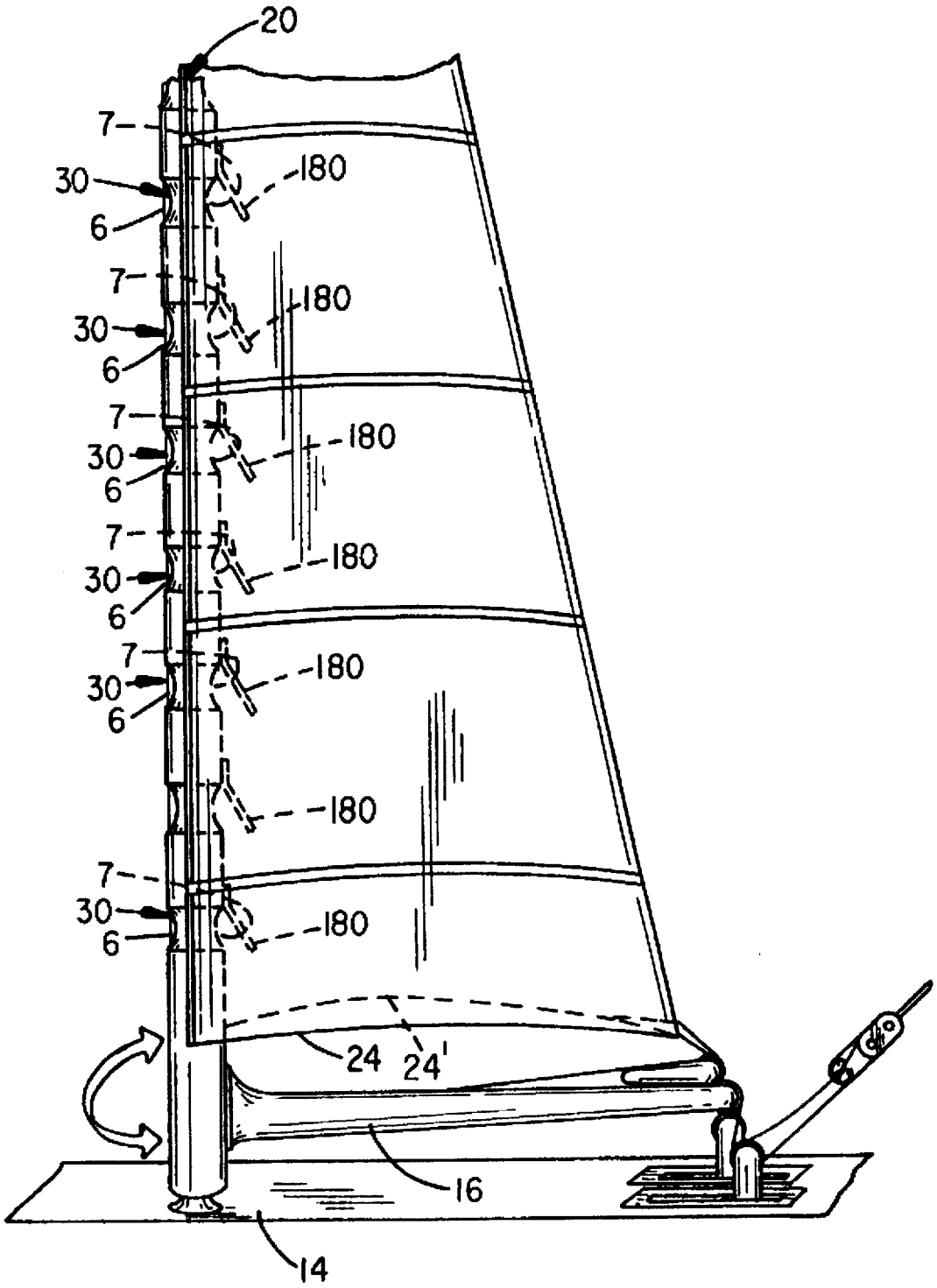
FIG. 9A is a side elevational view of an alternated embodiment of the present invention, illustrating a plurality of flaps 180 disposed along mast member 12 and inwardly distended to allow an inward flow of air into the internally disposed inflation cavity.
Figure 9B:
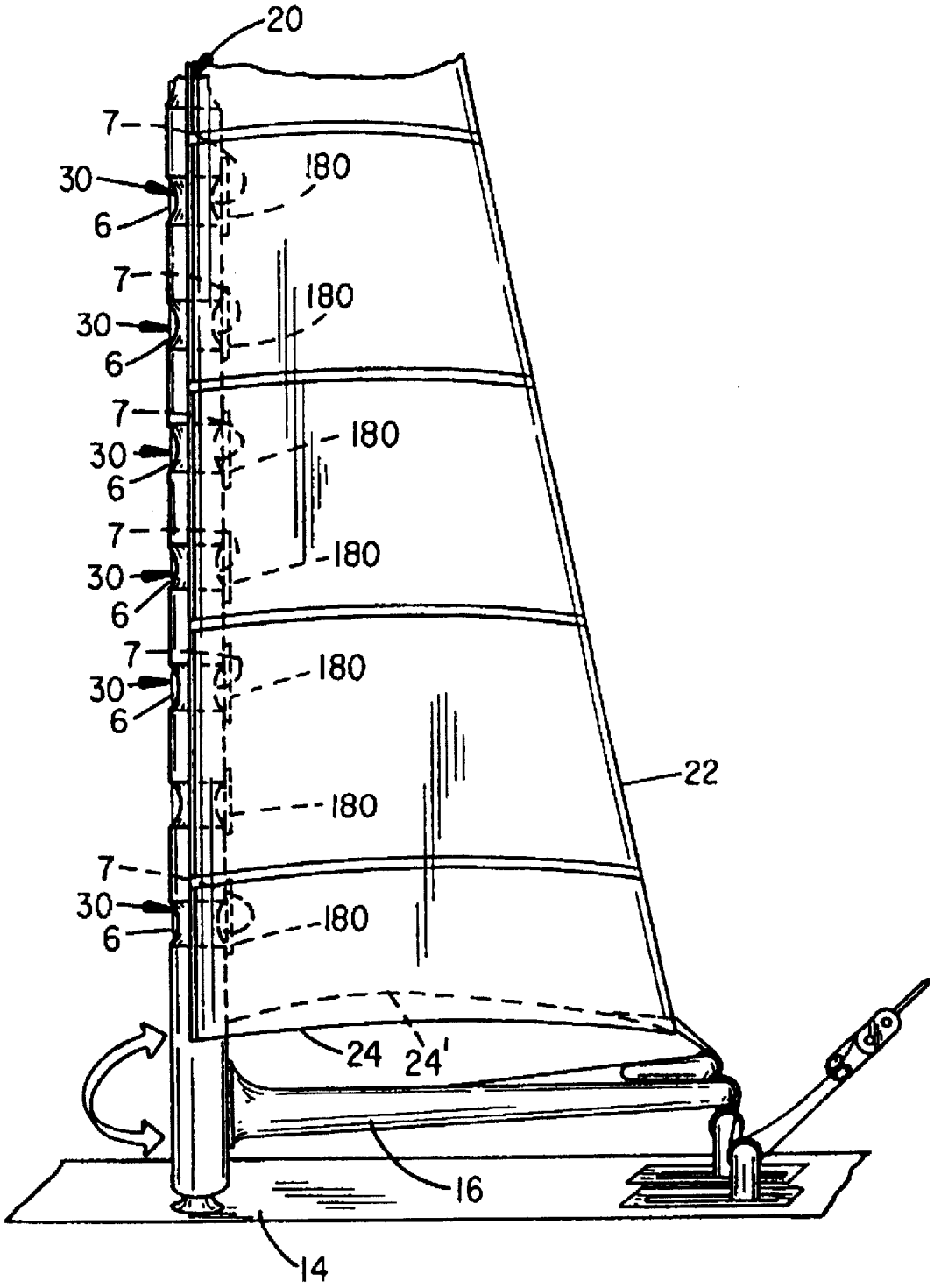
FIG. 9B is a side elevational view of the alternate embodiment shown in FIG. 9A, illustrating flaps 180 in a closed relation with the air inlet ports 30 to prevent an outward flow of air through air inlet ports 30.

For example, with reference to FIGS. 9A and 9B, it is contemplated that control means may be provided to limit or control the extent to which air enters inflation cavity. In a high wind situation, it may be advantageous to restrict the degree to which airfoil 18 is inflated so as to minimize any resultant drag or any overinflation that may occur. Conversely, in a low wind situation, it may be advantageous to allow the maximum amount of air into inflation cavity 8 to provide higher lift. To accomplish this, a plurality of simple check-valves or flexible flaps 180 may be provided in association with air inlet port 30 to permit the inward flow of air into inflation cavity 8, while preventing any airflow that may tend to flow back out of air inlet 30, such as is common when coming about during upwind tacking. FIG. 9A represents the situation wherein an impinging wind forces each flap 180 into a distended condition away from a covered relation with each air inlet port 30 to inflate inflation cavity 8.

Upon the instance when the inward airflow into inflation cavity 8 ceases or slows, such as when the vessel speed or wind speed decreases, each flap 180 will return to a flush relation with mast member 12 to close off each air inlet port 30. Therefore, the internal air pressure within airfoil 18 may be maintained when coming about or tacking, thereby minimizing the time required to obtain the proper aerodynamic shape of airfoil 18 on the new tack. Such airflow regulation means may be useful in preventing water from entering inflation cavity 8 of dynamically inflatable airfoil 18 during a condition where the sailing vessel is tipped over or capsized. In such a case, the internal air pressure within inflation cavity 8 may act to close the aforementioned check-valve or flaps 189 to prevent any inward flow of water, as well as increasing the buoyancy of mast member 12 for ease in righting the sailing vessel. In this same regard, it is contemplated to provide port and starboard foot edges 24, 24' with a selectively openable means extending therebetween, such as a zipper, for varying the degree to which air can flow out of inflation cavity 8. As with the flaps 180, a zipper or other progressively openable air outlet aperture may assist in controlling the degree to which airfoil 18 is inflated with the dynamically inflatable embodiment shown in FIGS. 1–4.

It is also fully contemplated that airfoil 18 may be constructed to be statically inflatable, in contradistinction to the dynamically inflatable embodiment shown in FIGS. 1–4, without departing from the scope of the present invention. Such a configuration would require inflation cavity 8 to be completely sealed along its periphery and equipped with a selectively openable nozzle or spout fitting, such as reference numeral 155 in FIGS. 5–7. Prior to use, a volume of air would be introduced into inflation cavity 8 via the selectively openable nozzle or spout fitting so as to provide the proper airfoil shape. In a similar regard, it is also contemplated to produce the statically inflatable airfoil 118 of FIGS. 5–7 in a dynamically inflatable version consistent with the teachings of FIGS. 1–4.

Figure 10:
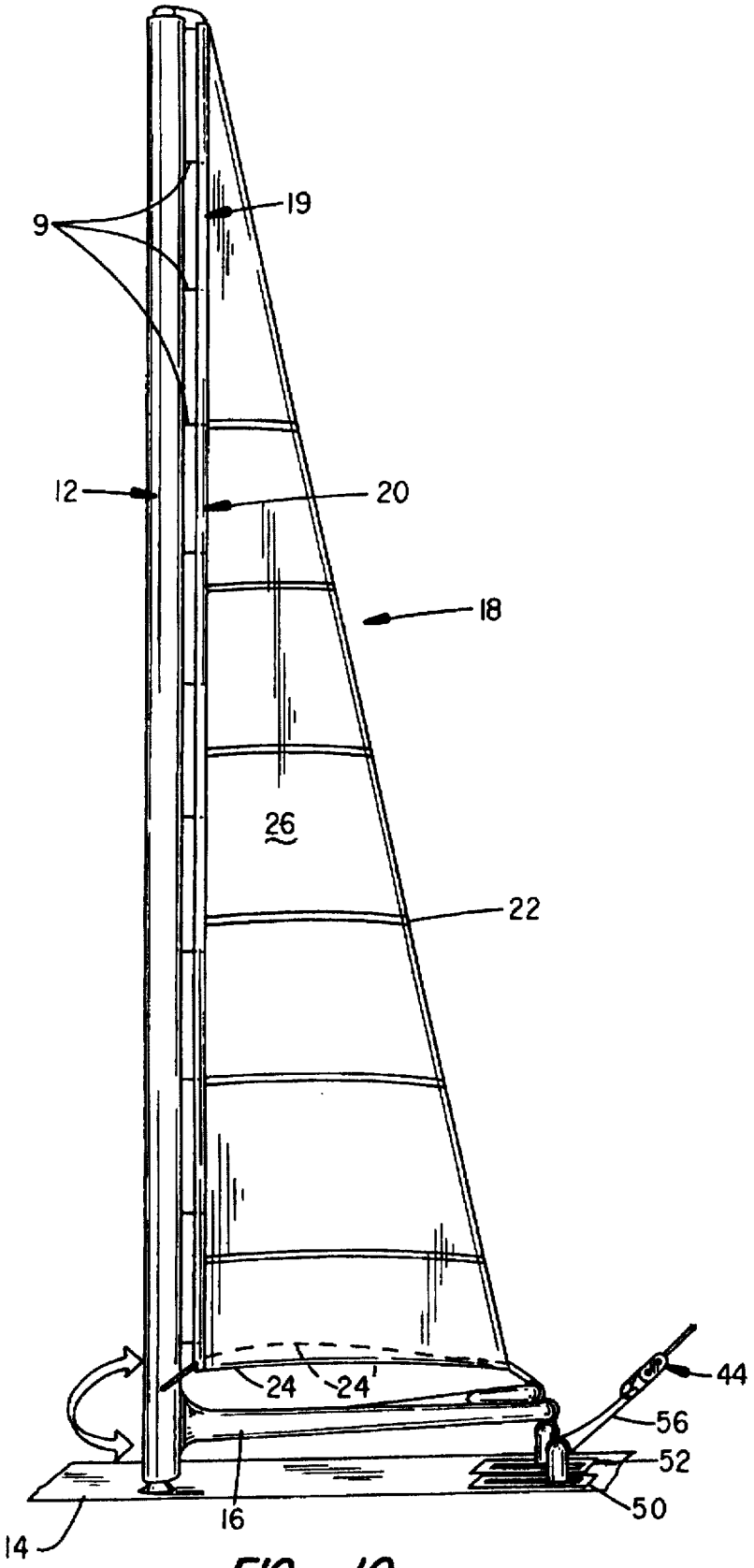
FIG. 10 is a side elevational view of yet another alternate embodiment of the present invention, illustrating airfoil 18 positioned a predetermined distance from mast member 12 via a plurality of stand-off members 9.
Figure 11:
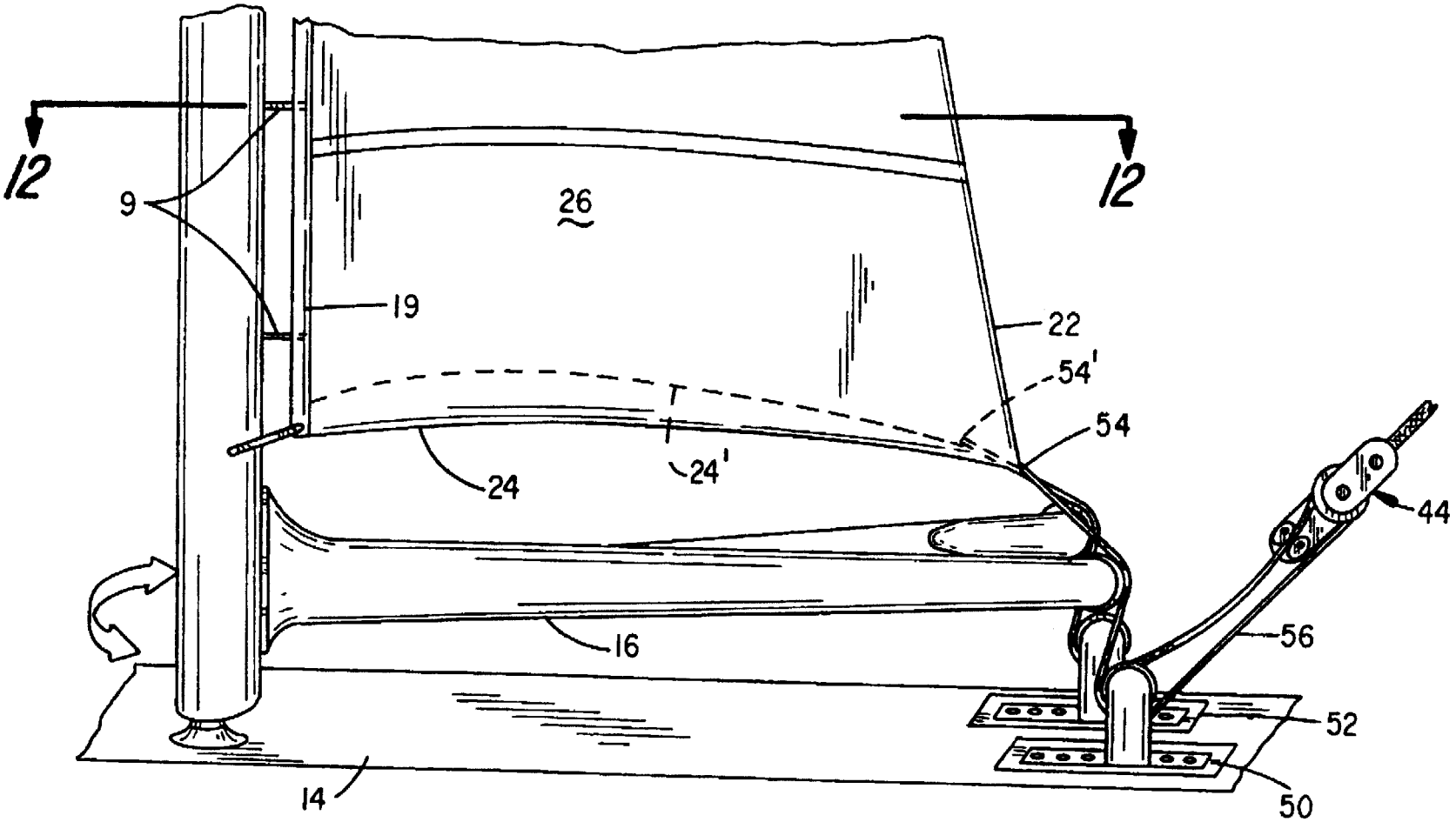
FIG. 11 is an enlarged view of that which is shown in FIG. 10, detailing the construction of airfoil 18.
Figure 12:
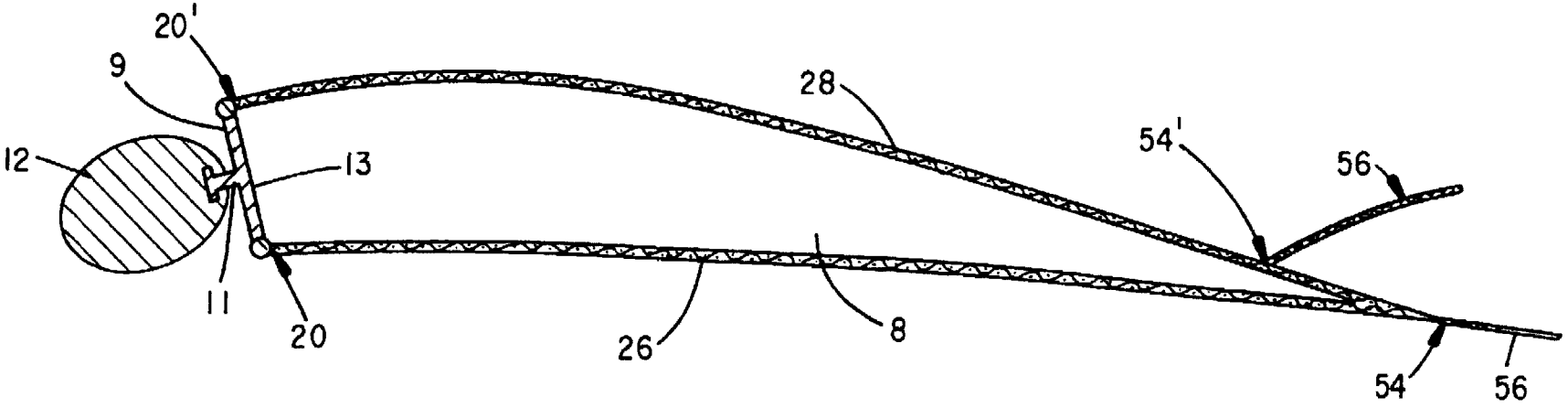
FIG. 12 is a partial sectional view taken along lines 12—12 of FIG. 12, further detailing the construction of airfoil 18.

Referring to FIGS. 10–12, it is further anticipated to provide airfoil 18 in a spaced relation to mast member 12 through the use of a plurality of stand-off members 9 extending between mast member 12 and airfoil 18, as may be required to retro-fit existing sailing vessels to further distribute the benefits of the present invention without the need to obtain an entirely new or custom-made mast. Each stand-off member 9 is rigid and has a slide portion 11 and a perpendicularly positioned cross bar portion 13 so as to be slidably hoisted through the internally disposed sail track of mast member 12, such as those typically employed in sailing vessels to raise and lower sails. To facilitate such hoisting, a flexible or semi-rigid linking portion 19 is provided to interconnect each stand-off member 9 along the length of mast member 12. By way of example and not limitation, linking portion 19 may be constructed of any variety of plastic or sail material. Port and starboard leading edges 20, 20' of airfoil 18 are attached to stand-off member 9 such that, when hoisted, port and starboard leading edges 20, 20' are positioned generally along the lateral opposing edges of mast member 12. Through this positioning, impinging wind is capable of flowing past mast member 12 and into inflation cavity 8 to produce the desired airfoil shape.

In addition, while mast member 12 is shown rotatably attached to deck surface 14, it should be evident to one skilled in the art that mast member 12 may be disposed in a non-rotatable, fixed relation to deck surface 14, such as is typically the case in larger sailing vessels or cruisers. With a fixed mast member 12, boom member 16 would necessarily need to be hingedly attached to mast member 12 to provide the ability to vary the angle of attack between the chord of airfoil 18 and the relative wind. Conversely, it is also contemplated that boom member 16 may be rigidly attached to mast member 12, rather that the hinged attachment shown in FIGS. 1–4. In such a configuration, mast member 12 would necessarily need to be rotatable so as to provide the ability to vary the angle of attack.

It should also be evident from an inspection of FIGS. 1–4 that multiple pairs of tension points may be provided to allow a wide range of adjustability for the camber of airfoil 18. In this same regard, tension points may be provided so as to be slidably moveable along opposing airfoil surfaces to provide a widened range of camber adjustability. Furthermore, the specific means for attaching tension lines 56, 135, 137 to any of the tension points disposed on an airfoil of the present invention is not critical and may include any number of readily available attachment means, such as rings, shackles, clips, and the like. It is also contemplated that a variety of adjustments means may be employed to effectuate the desired application of tension to the given tension points. For example, a single traveler having two individual rollers may be used to replace the dual travelers 50, 52 to eliminate the need to adjust each individual traveler 50, 52. Similarly, any variety of gear units, winches, blocks and tackles, turnbuckles, pulleys or vangs may be used, either alone or in combination, provide the proper application of tension to the tension points disposed on airfoil 18.

It is also important to note that the horizontally extending battens are not critical to the proper shaping of airfoils and may be omitted without departing from the scope of the present invention. It should also be noted that, if provided, the length of the battens should not exceed the length between the port and starboard leading edges and the particular pair of tension points being employed. This eliminates the possibility that the battens will in any way impede the selective formation of the trailing edge, thereby facilitating the proper shaping of the airfoil.

It is also contemplated that the mast member of the present invention, either in a dynamic or static inflation configuration, may be provided with an internal cavity capable of receiving airfoil 18 in an self-furling arrangement. In such a case, the mast member may be equipped with means for progressively furling the airfoil into an internally disposed chamber within the mast member. It is also conceivable to provide such furling means on the exterior of the mast member to avoid the added space requirements of providing an internally disposed storage chamber to accept the furled airfoil.

An airfoil of the present invention may be constructed in any number of fashions with any number of sail cloth material. For example, the materials for manufacturing the airfoil panels may include, but are not limited to, Dacron, nylon, Mylar, and Kevlar, while the construction techniques may include, but are not limited to, a miter cut, crosscut, mini-miter cut, radial cut, or a spider web cut. Any variety of warp thread arrangements and bias elongation scenarios may also be employed to improve the dynamics of the aforementioned airfoils of the present invention.

Therefore, in light of the foregoing, the present invention provides an airfoil that is free from internal support ribs, thereby minimizing the likelihood that water will become trapped within the airfoil during a condition wherein the vessel is tipped over or capsized, and simple in construction and light in weight, thereby minimizing the potential that the vessel will tip over during heavy winds.

More importantly, the present invention provides an airfoil having a variable camber that is capable of being fine tuned in response to variations in angle of attack and wind conditions so as to maximize the aerodynamic efficiency of the airfoil. With the foregoing benefits in mind, the present invention is ideal for use with virtually every type of sailing vessel, including those having rotatable masts, such as scows, iceboats, and catamarans, as well as those having fixed masts, such as yawls and ketches.

What is claimed is:

1. An airfoil assembly for use with a sailing vessel, comprising:

mast means having an upper end and a lower end, said lower end being coupled to said sailing vessel and said upper end extending generally vertically away therefrom;

boom means having a first end coupled to said mast means and a second end extending distally therefrom;

inflatable airfoil means having an internally disposed inflation cavity, said inflation cavity being bounded by leading edge means positioned adjacent to said mast means, foot edge means extending from said second end of said boom means toward said mast means, and trailing edge means extending between said second end of said boom means and said upper end of said mast means, said leading edge means including a first leading edge and a second leading edge disposed in spaced relation proximate said mast means, said airfoil means further including first tension point means disposed a predetermined distance away from said first leading edge, second tension point means disposed a predetermined distance away from said second leading edge, and air injection means for introducing a volume of air into said inflation cavity to force said airfoil means into an airfoil shape; and adjustment means attached to said first and second tension point means for selectively forming said trailing edge means at one of said first and second tension point means to thereby selectively adjust the camber of said airfoil means.

2. The inflatable airfoil assembly as set forth in claim 1 and further, said boom means including first and second boom arm means each having a first end coupled to said mast means and a second end extending distally therefrom, said adjustment means including at least one generally elongated connecting arm means hingedly disposed between said first and second boom arm means for manipulating the position of said first and second boom arm means relative to said at least one connecting arm means to adjust the camber of said airfoil means.

3. The inflatable airfoil assembly as set forth in claim 2 and further, wherein said inflation cavity is sealed along said foot edge means, said trailing edge means, and said first and second leading edges, said air injection means including at least one selectively openable air injection port disposed in communication with said inflation cavity for introducing a predetermined volume of air into said inflation cavity.

4. The inflatable airfoil assembly as set forth in claim 1 and further, said air injection means comprising at least one air inlet aperture formed between said first and second leading edges, said mast means including at least one air inlet means extending therethrough for facilitating the inward flow of air through said at least one air inlet aperture into said inflation cavity.

5. The inflatable airfoil assembly as set forth in claim 1 and further, including stand-off means disposed between said mast means and said airfoil means for positioning said airfoil means a predetermined distance from said mast means.

6. The inflatable airfoil assembly as set forth in claim 4 and further, including airflow control means for controlling the inflation of said airfoil means.

7. The inflatable airfoil assembly as set forth in claim 6 and further, said airflow control means comprising at least one responsively movable member disposed proximate said at least one air inlet means of said mast means capable of controlling the degree to which air flows into and out of said inflation cavity.

8. The inflatable airfoil assembly as set forth in claim 7 and further, said at least one responsively movable member comprising check-valve means for permitting the inflation of said inflation cavity and preventing the deflation of said inflation cavity.

9. The inflatable airfoil assembly as set forth in claim 6 and further, wherein said airflow control means includes a selectively openable air exhaust port disposed proximate said foot edge means.

10. An inflatable airfoil for use with a sailing vessel having a mast member and a boom member, said inflatable airfoil comprising:

first panel means extending between leading edge means, foot edge means, and trailing edge means, said first panel means having first tension point means disposed thereon;

second panel means extending between said leading edge means, said foot edge means, and said trailing edge means, said second panel means having second tension point means disposed thereon;

air injection means for introducing a volume of air between said first and second panel means to form an internally disposed inflation cavity therebetween; and adjustment means attached to said first and second tension point means for forming said trailing edge means at the approximate location of one of said first and second tension point means to thereby selectively adjust the camber of said airfoil.

11. The inflatable airfoil as set forth in claim 10 and further, said first and second panel means positioned in spaced relation proximate said mast member to form at least one air inlet aperture in fluid communication with said inflation cavity, said air injection means comprising at least one air injection port extending through said mast member and generally positioned with said at least one air inlet aperture to facilitate the inward flow of air into said inflation cavity.

12. The inflatable airfoil as set forth in claim 11 and further, including airflow control means for controlling the inflation of said inflation cavity.

13. The inflatable airfoil as set forth in claim 12 and further, said airflow control means comprising at least one responsively movable member disposed proximate said at least one air inlet port of said mast member for controlling the degree to which air flows into and out of said inflation cavity.

14. The inflatable airfoil as set forth in claim 12 and further, said airflow control means comprising at least one selectively openable air exhaust port disposed proximate said foot edge means.

15. The inflatable airfoil as set forth in claim 10 and further, said first panel means being sealably attached to said second panel means along said foot edge means, said trailing edge means, and said leading edge means to sealably enclose said inflation cavity, said air injection means comprising at least one selectively openable air inlet port disposed in communication with said inflation cavity.

16. The inflatable airfoil as set forth in claim 15, said adjustment means further including a tension line having a first end and a second end, said first end being attached to said first tension point means, said second end being attached to said second tension point means, said adjustment means further including means for selectively adjusting the tension applied to said first end and said second end of said tension line.

17. The inflatable airfoil as set forth in claim 16 and further, wherein said first tension point means and said second tension point means are disposed proximate said foot edge means.

18. The inflatable airfoil as set forth in claim 17 and further, wherein said means for selectively adjusting the tension applied to said first end and second end of said tension line comprises a jam cleat in conjunction with at least one block and tackle assembly, said at least one block and tackle assembly being selectively positionable in relation to said second end of said boom member to regulate the extent to which said mast member experiences rotation during use.

19. The inflatable airfoil as set forth in claim 10 and further, including stand-off means attached to said airfoil for positioning said airfoil a predetermined distance from said mast member.

20. A method for improving the aerodynamic efficiency of a sailing vessel, said sailing vessel having a mast member and a boom member, comprising the steps of:

(i) providing airfoil means having an internally disposed inflation cavity, said inflation cavity being bounded by leading edge means, foot edge means, and trailing edge means, said airfoil means having first tension point means disposed a predetermined distance from said leading edge means, second tension point means disposed a predetermined distance from said leading edge means, and air injection means for introducing a volume of air into said inflation cavity;

(ii) introducing a volume of air into said inflation cavity to produce an internal air pressure capable of forcing said inflation cavity into spaced relation to assume a generally airfoil shape;

(iii) providing adjustment means in attachment with said first and second tension point means for selectively forming said trailing edge means at the approximate location of one of said first and second tension point means; and (iv) adjusting said adjustment means to vary the camber of said airfoil means.

21. The method as set forth in claim 20 and further, said boom member including a first boom arm and a second boom arm, step (iii) further comprising the sub-step of providing connecting means disposed between said first and second boom arms, and step (iv) further comprising the sub-step of manipulating the position of said first and second boom arms relative to said connecting means to adjust the camber of said airfoil means.

22. The method as set forth in claim 21 and further, step (i) comprising the further sub-step of sealing said inflation cavity along said leading edge means, said foot edge means, and said trailing edge means, and step (ii) comprising the further sub-step of providing at least one selectively openable air injection port disposed in fluid communication with said inflation cavity.

23. The method as set forth in claim 20 and further, step (i) comprising the further sub-step of providing air inlet means formed along said leading edge means and in fluid communication with said inflation cavity, and step (ii) comprising the sub-step of providing air injection means extending through said mast member and generally aligned to direct air into said air inlet means, and the further sub-step of driving air into said air injection means to inflate said inflation cavity into a generally airfoil shape.

24. The method as set forth in claim 23 and further, step (i) comprising the further sub-step of providing airflow control means for controlling the inflation of said inflation cavity.

25. The method as set forth in claim 24 and further, said sub-step of providing airflow control means including the further sub-step of positioning at least one responsively movable member disposed proximate said at least one air inlet port of said mast member for controlling the degree to which air flows into and out of said inflation cavity.

26. The method as set forth in claim 24 and further, said sub-step of providing airflow control means including the further sub-step of providing at least one air exhaust port disposed in fluid communication with said inflation cavity for facilitating the outward flow of air from within said inflation cavity.

27. The method as set forth in claim 23 and further, step (iii) comprising the sub-step of providing a tension line having a first end capable of being removably attached to said first tension point means a second end capable of being removably attached to said second tension point means, and the further sub-step of providing means for selectively adjusting the tension applied to said first and second ends of said tension line.

28. The method as set forth in claim 27, said step of providing means for selectively adjusting the tension applied to said first and second ends of said tension line comprising the sub-step of providing a jam cleat and at least one block and tackle assembly in association with said tension line for selectively adjusting the length of said tension line, and the further sub-step of selectively positioning said at least one block and tackle assembly in relation to said second end of said boom member to regulate the extent to which said mast member experiences rotation during use.

29. The method as set forth in claim 20 and further, step (i) including the further sub-step of providing stand-off means attached to said airfoil means for positioning said airfoil means a predetermined distance from said mast member.

* * * * *